US007614260B2

(12) United States Patent
Daniels et al.

(10) Patent No.: US 7,614,260 B2
(45) Date of Patent: Nov. 10, 2009

(54) SYSTEM FOR MONITORING OZONE AND CONTROLLING SUPPLY OF OZONE TO WASHING MACHINE

(75) Inventors: Ralph G. Daniels, Derry, NH (US); David A. Spofford, Northwood, NH (US)

(73) Assignee: Daniels Equipment Company, Inc., Auburn, NH (US)

( * ) Notice: Subject to any disclaimer, the term of this patent is extended or adjusted under 35 U.S.C. 154(b) by 607 days.

(21) Appl. No.: 11/242,264

(22) Filed: Oct. 3, 2005

(65) Prior Publication Data

US 2006/0096038 A1 May 11, 2006

(30) Foreign Application Priority Data

Nov. 5, 2004 (GB) ..... 0410405.5

(51) Int. Cl.
*D06F 33/00* (2006.01)

(52) U.S. Cl. ..... 68/12.02; 68/12.12; 68/183; 68/207

(58) Field of Classification Search ..... 8/137, 8/147, 149.1, 158; 68/3 R, 5 R, 12.02, 207
See application file for complete search history.

(56) References Cited

U.S. PATENT DOCUMENTS 3,884,265 A * 5/1975 Fry et al. ..... 137/565.16
5,625,915 A * 5/1997 Radler et al. ..... 8/158
5,688,289 A * 11/1997 Nishioka et al. ..... 8/137
5,811,662 A * 9/1998 Williams et al. ..... 73/31.06
5,960,501 A * 10/1999 Burdick ..... 8/158
6,115,862 A * 9/2000 Cooper et al. ..... 8/158
6,691,536 B2 * 2/2004 Severns et al. ..... 68/12.27
2004/0146437 A1 * 7/2004 Arts et al. ..... 422/186.07
2005/0268404 A1 * 12/2005 Laithwaite ..... 8/158

* cited by examiner

*Primary Examiner*—Michael Barr
*Assistant Examiner*—David Cormier
(74) *Attorney, Agent, or Firm*—Davis & Bujold, P.L.L.C.

(57) ABSTRACT

A system for controlling a supply of ozone to a washing machine during operation thereof. The system comprising a washing machine having an internal drum for containing laundry and a quantity of a water. An ozone generator is connected to the washing machine and the ozone generator produces and supplies the produced ozone to the washing machine for ozonating the water. At least one sensor is provided for sensing a quantity of ozone exhausting from the washing machine during operation thereof, and the at least sensor being coupled to the ozone generator for interrupting production of ozone when a quantity of ozone exhausting from the washing machine exceeds a safe level.

12 Claims, 7 Drawing Sheets

SYSTEM FOR MONITORING OZONE AND CONTROLLING SUPPLY OF OZONE TO WASHING MACHINE

FIELD OF THE INVENTION

The present invention relates to a washing machine, an ozone dissolving apparatus, a system for controlling the supply of ozone and a method of washing which uses ozone to clean, sanitize and disinfect laundry.

BACKGROUND OF THE INVENTION

Washing of laundry is an expensive process. It utilizes costly resources—water, energy, detergents and labor and such laundering is often required to disinfect the laundry items. While conventional detergents and soap can be effective in removing dirt, grease, grime and other contaminants, they are not always effective at killing germs and bacteria. It is known to enhance the disinfection capabilities of a washing machine by introducing ozone into the washing water. The ozone improves cleaning of laundry, at low wash water temperatures, and also has an antibacterial effect.

Previous systems for introducing ozone have included a simple bubble system in which ozone is bubbled through water in a washing machine drum. The efficiency of dissolving ozone in such apparatus is low, and the concentration of dissolved ozone in the water is consequently low thereby resulting in only a small enhancement in the cleaning and the antibacterial effect of the ozone. There is also the disadvantage that the amount of off-gas, i.e., the ozone given off to the surrounding environment during operation of the washing machine, can be considerable. The ozone gas will typically collect in the area surrounding the washing machine and can cause health and safety problems in the event that any person located adjacent the washing machine is exposed to a high concentration of ozone.

In order to improve the efficiency with which ozone is dissolved in the water, systems using venturis have been developed. Such systems forcibly dissolve ozone in the water and improve the concentration of dissolved ozone. However, these systems are complex and often require major changes to the plumbing or pipework of the washing machine in order to install such systems. In addition, further space is also required for the venturi itself and associated components, such as tanks and pumps.

Another problem associated with prior art washing machine having an ozone generating system is that there is no mechanism for controlling the amount of ozone generated during a wash cycle. As a result of this, a dangerous level of ozone can be generating during operation of the washing machine, especially at a laundry mat or a commercial laundry facility, thereby creating a situation which is hazardous to human beings.

SUMMARY OF THE INVENTION

It is an object of the present invention to efficiently add ozone to water used in a washing machine without having to make substantial changes to the plumbing or pipework connected to the washing machine.

It is another object of the present invention to provide a system in which the amount of ozone generated, during a wash cycle, is controlled so that an optimum amount of ozone is generated and the laundry is efficiently and consistently cleaned.

Yet another object of the present invention is to ensure that a sufficient amount of ozone is generated during the initial step or stage of the wash cycle, where the ozone can be readily used to "burn off" the dirt, grease, grime and other contaminants as well as kill "super bugs", germs and bacteria (i.e., ozone is effective in killing 99.99% of the germs and bacteria contained within the laundry), while having the ability to control, interrupt or reduce the amount of ozone generated during the latter step(s) or stage(s) of the wash cycle when less ozone is typically required.

Still another object of the present invention is to provide the system with a sensor which will completely shut off production of ozone, or possible sufficiently reduce production of ozone, in the event that the ozone being exhausted from the washing machine indicates that excess ozone still remains within the washing machine, e.g., indicates an ozone level exhausting from the washing machine of 1.0 (ppm) parts per million of higher.

Another object of the present invention is to provide the system with a fail safe sensor which will completely shut down the washing machine ozone, or possible sufficiently reduce production of ozone, in the event that the ozone level, in the room or area accommodating the washing machine, increases above a level which creates a hazardous situation for the health and/or safety of human beings, e.g., the ozone level in a room reaches 0.1 (ppm) parts per million.

A further object of the present invention is to minimize the amount of water and soap utilized during washing of laundry while also utilizing an adequate amount of the ozone to activate the soap or laundry detergent and the laundry to efficiently and consistently clean the laundry while also killing any germs or bacteria contained in the laundry being washed.

A still further object of the present invention is to inject the produced ozone, having a particle size of about 2 microns to 20 microns and more preferably having a particle size of from about 5 to 10 microns, into a relatively small sump of the washing machine, which is typically located beneath the washing machine, such that the ozone does not readily dissolved within the water but is essentially encapsulated and dispersed throughout the water and is readily available to react with any dirt, soil, grime, grease, germs, bacteria, etc., contained in the laundry being wash.

Accordingly, in a first aspect there is provided a washing machine comprising a washing volume and a mixing chamber below the washing volume and a fluid communication therewith and at least one sparger within the mixing chamber for connection to an ozone source.

The mixing chamber can be smaller than the washing volume since it need only contain the sparger rather than the sparger and any laundry. When the mixing volume is not much larger than the sparger, passing ozone through the sparger can produce strong currents in the mixing volume. This results in active circulation of the ozone containing water in and out of the mixing chamber and hence throughout the washing volume.

Preferably, the washing machine comprises an ozone source connected to the sparger.

Preferably, the washing volume and mixing chamber are in fluid communication via drain outlet in the washing volume. The drain outlet can be in the underside of the washing volume. This ensures that the mixing chamber fills before the washing volume.

The washing machine can further comprise a drain valve extending between the drain outlet and the mixing chamber. The washing machine can further comprise a drain valve extending from the underside of the mixing chamber.

Preferably, the washing machine further comprises a controller for controlling the flow of ozone to the sparger. The sparger can be arranged such that in use ozone exits the sparger in a downward direction. This increases the circulation of water within the mixing chamber and hence throughout the washing volume.

In a further aspect of the invention there is provided an ozone dissolving apparatus for the washing machine, the washing machine comprising a washing volume having a drain outlet in the washing volume wall, the apparatus comprising a mixing chamber having an aperture for connection to the drain outlet; and at least one sparger positioned within the mixing chamber and being for connection to an ozone source.

Preferably the ozone is injected into the water and is substantially suspended and entrained within the water without a significant portion of the ozone being dissolved therein. The water acts as a carrier agent and carries the ozone to the clothing and laundry to be cleaned and sanitized.

The apparatus according to the invention can be connected to the drain aperture of the standard washing machine allowing efficient addition of ozone to the laundry to be washed without an increase in the complexity of the associated plumbing.

Preferably, the apparatus comprises a drain valve connected between the drain outlet and mixing chamber. The mixture chamber can comprise a drain valve.

In a further aspect of the invention there is provided a method of washing comprising providing a washing machine, the washing machine comprising a washing volume and a mixing chamber below the washing volume and in fluid communication therewith and at least one sparger within the mixing chamber for connection to an ozone source at least partially filling the mixing chamber with water so as to submerge the sparger and dissolving ozone gas in the water by passing ozone through the sparger.

The ozone can be passed downwardly through the water.

The present invention relates to a system for controlling a supply of ozone to a washing machine during operation thereof, the system comprising: a washing machine having an internal drum for containing laundry and a quantity of a water; an ozone generator, connected to the washing machine, for producing ozone and supplying the produced ozone to the washing machine and ozonating the water; and at least one sensor for sensing a level of ozone being exhausting from the washing machine during operation thereof, and the at least sensor being coupled to interrupt production of ozone, by the ozone generator, when the level of ozone exhausting from the washing machine exceeds a safe level.

The present invention also relates to a system for controlling a supply of ozone supplied for laundering clothing, the system comprising a plurality of washing machines with an air supply device for supplying air to each of the plurality of washing machines; and each of the plurality of washing machines comprising: an internal drum for containing laundry and a quantity of a water; a sump located vertically below the washing machine, and the sump having a drain valve facilitating retention of the water supplied to the washing machine; and an air flow control valve for regulating a flow rate of the air being supplied to the washing machine, and the air flow control valve being connected to an ozone generator for producing ozone from the air, and the ozone generator being connected with the sump to supply the produced ozone to the washing machine; an ozone exhaust sensor for sensing a level of ozone exhausting from the washing machine during operation thereof, and the ozone exhaust sensor being coupled to interrupt production of ozone by the ozone generator when the level of ozone exhausting from the washing machine exceeds a safe level; an area ozone level sensor for detecting a level of the ozone contained within an area accommodating the plurality of washing machines, and in an event that the area ozone level sensor detects the ozone level for the area to be above the safe level, the area ozone level sensor interrupts further production of ozone by each one of the ozone generators until the area ozone level sensor again detects a safe level of ozone.

The present invention further relates to a method of controlling a supply of ozone to a washing machine during operation thereof, the method comprising steps of: providing a washing machine with an internal drum for containing laundry and a quantity of a water; adding laundry and water to the internal drum; producing ozone in an ozone generator and supplying the produced ozone to the water located within a sump of the washing machine for ozonating the water contained therein; washing the laundry in the for ozonated water and sensing a level of ozone exhausting from the washing machine during operation and, if a level of the ozone exhausting from the washing machine exceeds a safe level, interrupting production of further ozone until the level of the ozone exhausting from the washing machine falls below the safe level.

BRIEF DESCRIPTION OF THE DRAWINGS

Preferred embodiments of the present invention will now be described, by way of example only and not in any limitative sense, with reference to the appended drawings in which.

DETAIL DESCRIPTION OF THE DRAWINGS

Figure 1:
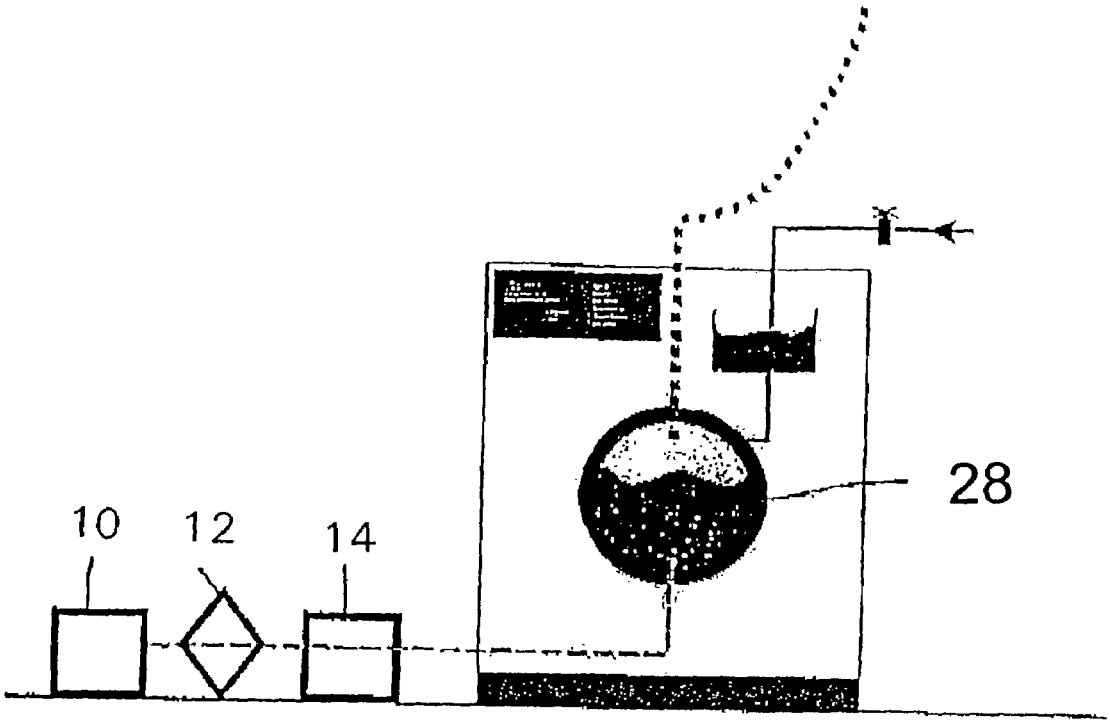
FIG. 1 is a schematic diagram of a known washing machine including an ozone source.

Shown in FIG. 1 is a schematic diagram of a known prior art washing machine. A compressor 10 supplies air to an air preparation unit 12 which dries the air. The dried air is then passed to an ozone generator 14. The ozone generation 14 then generates ozone gas from air and supplies the ozone gas through an inlet to a washing machine drum. The ozone gas is injected into and bubbles through the water in the drum 28 and a small amount of the ozone will dissolve in the water. The efficiency of dissolving the ozone gas in the water, according to this prior art washing machine is, however, fairly low.

Figure 2:
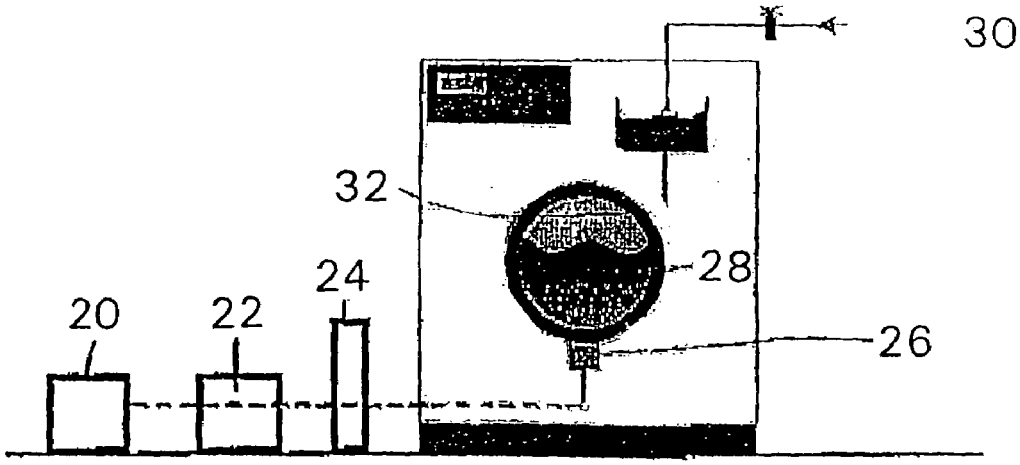
FIG. 2 is a schematic diagram of a washing machine according to the present invention.

A first embodiment of a washing machine, according to the present invention, is depicted in FIG. 2. An oxygen generator 20 generates oxygen which is supplied to an ozone generator 22. The ozone is then supplied through a controller 24 which controls the supply of ozone into mixing chamber 26.

An aperture of the mixing chamber is connected to a drain outlet in the washing volume. The drain outlet of this embodiment is arranged at the lowest vertical point of the volume of the washing liquid contained within the washing machined. A drain valve (not shown) extends from the underside of the mixing chamber allowing the washing volume to be removed or drained as required. Water from a water supply 30 is supplied to an inlet 32 towards the top of the washing volume.

Figure 3:
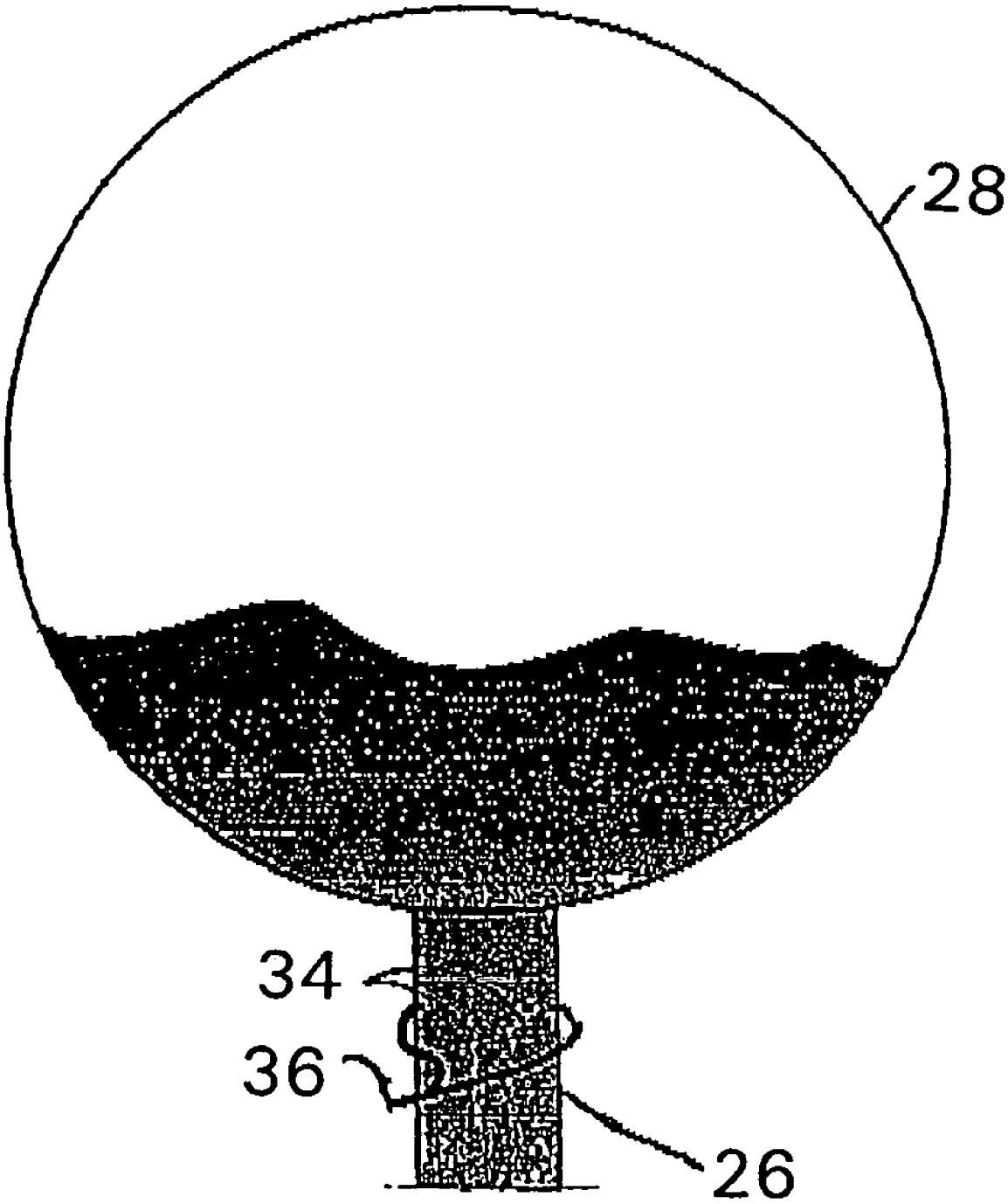
FIG. 3 is an enlarged view showing the construction of the mixing chamber of the washing machine in FIG. 2.

As can be seen in FIG. 3, the mixing chamber is arranged below the washing volume. Accordingly, as water is added to the washing volume, such water flows into the mixing chamber which is initially filled before the washing volume.

Figure 6:
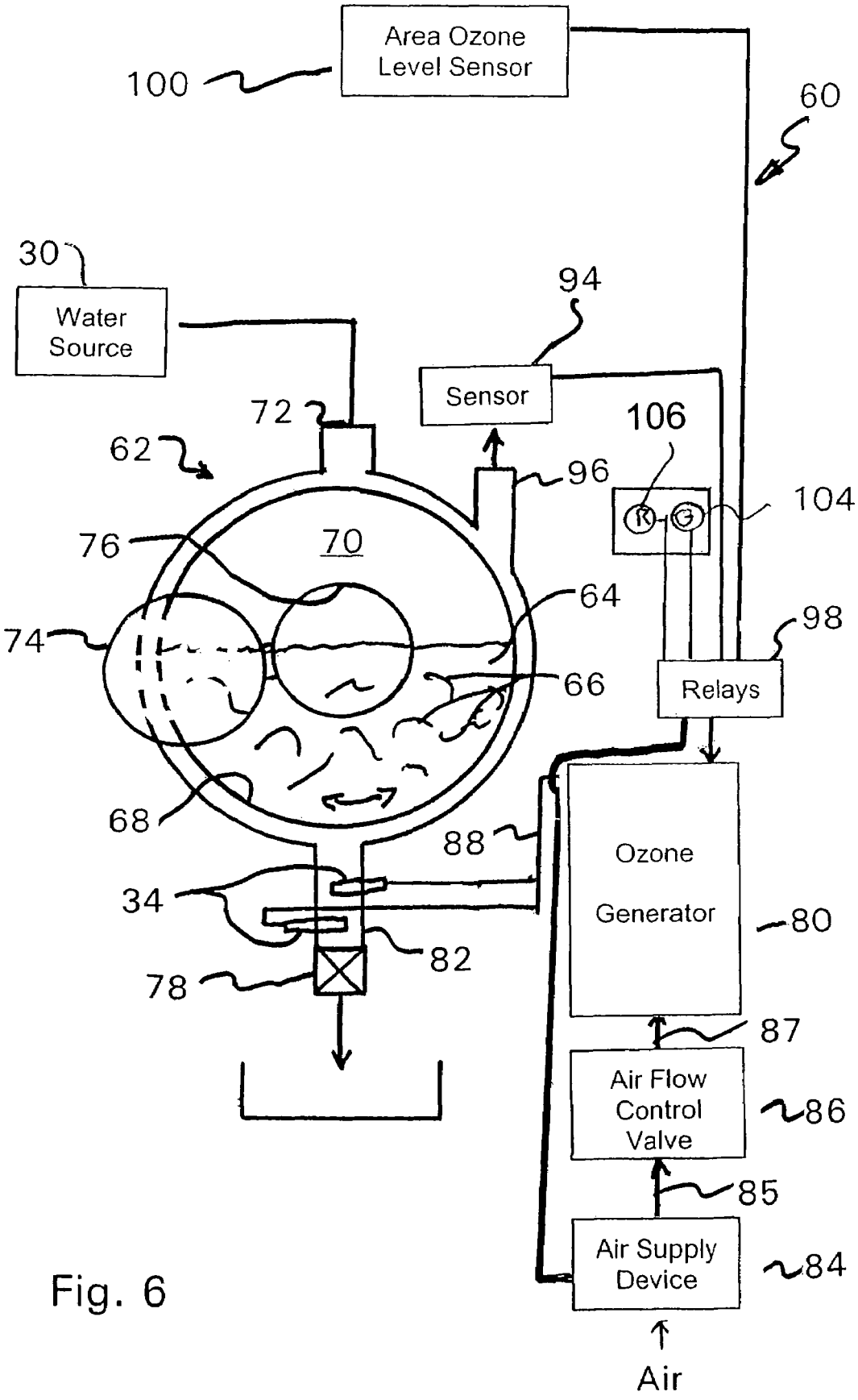
FIG. 6 shows an improved system, according to the present invention, for controlling a supply of ozone to a washing machine.
Figure 7:
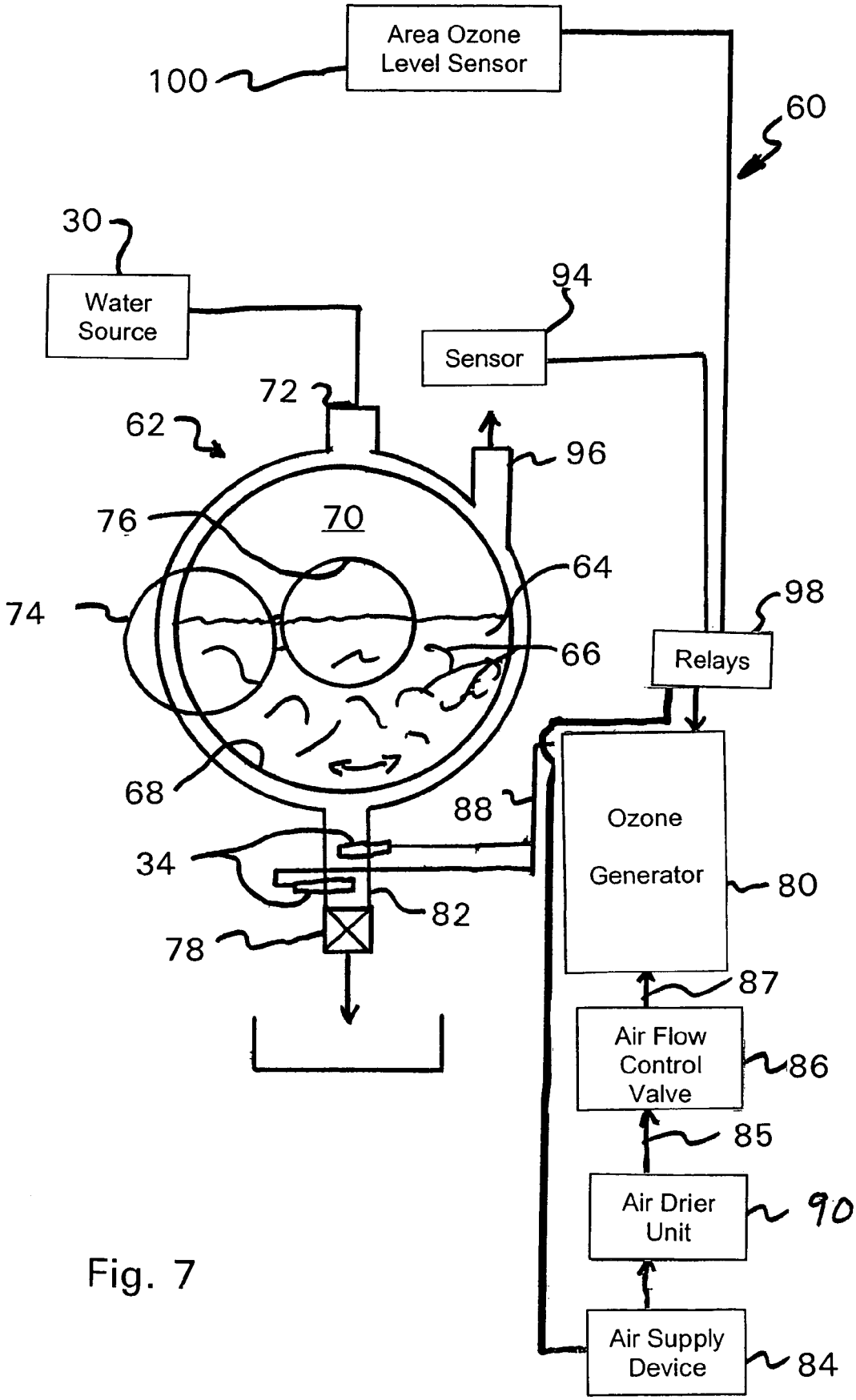
FIG. 7 shows a modification to the improved system of FIG. 6 having an air drier unit.
Figure 8:
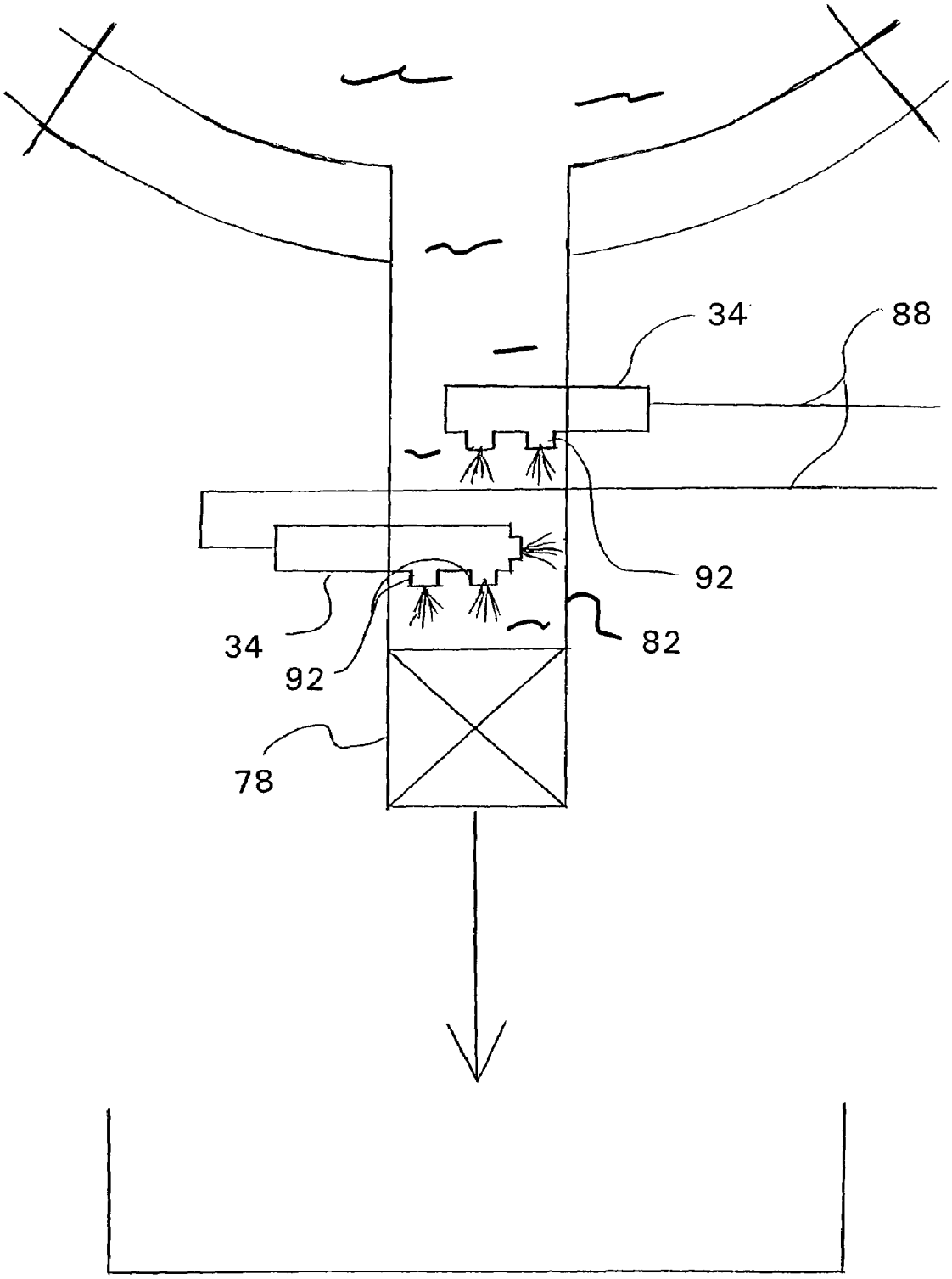
FIG. 8 shows injection of the ozone into the sump via the sparger injection nozzles.

The mixing chamber 26 contains at least one sparger 34 which is generally sufficient for a washing machine having a wash capacity of up to about 125 pound, for example. For a washing machine with a larger wash capacity, e.g., a wash capacity of about 100 pounds or greater, preferably two or more spargers 34 are utilized. As shown in FIGS. 6, 7 and 8, a pair of separate spaced apart sparges 34, each in the form of a perforated pipe preferably extending generally horizontally within the mixing chamber 26, are provided. If desired, the sparges 34 may be directed toward the bottom of the mixing chamber 26 to assist with dispersion and mixing of the ozone within the mixing chamber 26. Ozone from the ozone generator 22 is supplied to the spargers 34 by gas pipes 36.

During operation of the washing machine, a user inserts laundry to be washed into an internal drum 28 contained within the primary washing volume of the washing machine. The drain valve is closed and water is supplied into the drum 28 from the water supply 30. When the drain valve closes, the ozone supply controller 24 receives a signal that the drain valve is closed and begins operating and commences supplying ozone to the spargers 34 located within the mixing chamber 26.

As ozone is supplied to the spargers 34, the ozone escapes through the perforations located in the sides of the spargers and also through the downward end face of the spargers 34. The escaping ozone causes the water to circulate within the mixing chamber 26 and thereby results in efficient mixing of the ozone with the waterwithin the mixing chamber 26. Furthermore, because the spargers 34 are directed or angled downwards, the ozone emerging from the ends of the spargers 34 initially travels vertically downward and then must travel or move upwards through the entire height of the mixing chamber and the washing volume. This enhances the dissolving, dispersion and/or encapsulation of ozone within the washing volume and ensures that the ozone is in intimate contact with water for as much and as long of the wash process as possible, and also results in improved circulation of water into and out of the mixing chamber 26.

The washing machine then commences a desired washing cycle (e.g., a normal wash cycle, a heavily soiled wash cycle, a delicate wash cycle, etc.) and ozone is supplied by the controller throughout the entire period of time that the drain valve is closed to ensure that the ozone added to and/or dissolved in the water is continuously regenerated and/or replaced and is readily available, as necessary, during the entire wash cycle.

During the wash cycle, the drum 28 of the washing machine rotates in a conventional fashion, e.g., in a to and fro fashion, to agitate the laundry and facilitate cleaning and sanitation thereof. Such agitation enhances the cleaning and also enhances the circulation of the water into and out of the mixing chamber 26.

It will be appreciated that although this embodiment uses two spargers 34, either more or less spargers may be used in alternative embodiments of the present invention.

According to an alternative embodiment of the invention, the mixing chamber is located separately from the drain outlet. It is still located vertically below the washing volume to ensure that the mixing chamber is completely submerged and filled with water from an early point in the washing cycle.

In a further embodiment of the invention, a drain valve is connected between mixing chamber and washing volume to allow the ozone system to be readily disconnected if necessary or required.

Figure 4:
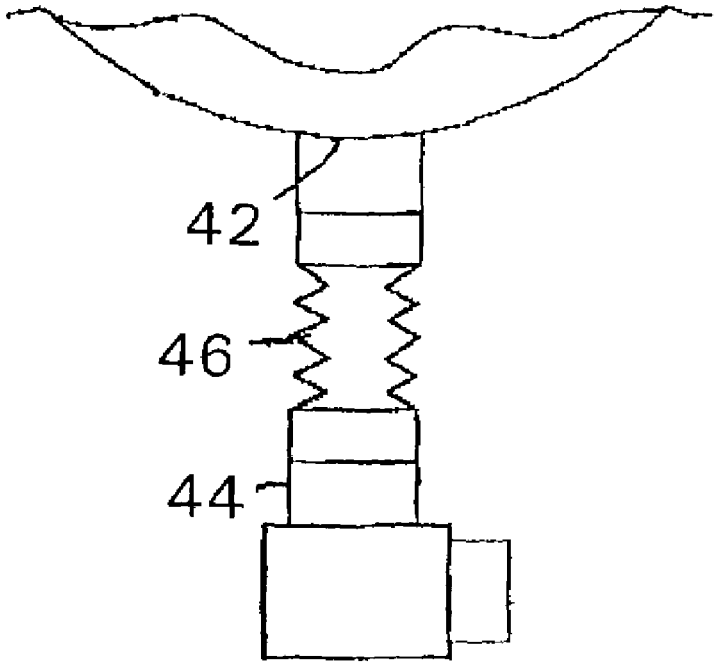
FIG. 4 is a diagram of a known connection between the washing machine and the drain.
Figure 5:
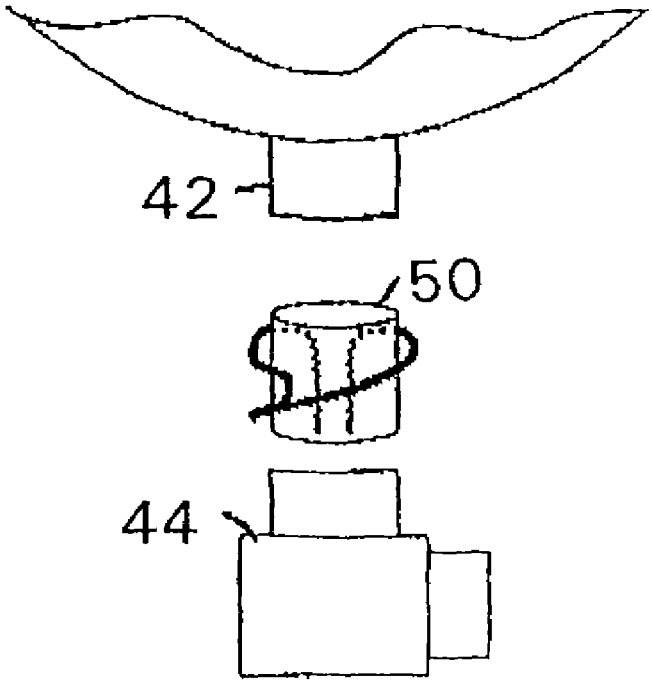
FIG. 5 shows the connection of an ozone dissolving apparatus, according to the invention, to the washing machine depicted in FIG. 4.

An embodiment of the ozone dissolving apparatus, according to the present invention, is illustrated in FIG. 5. This embodiment provides a mixing chamber which can be retrofitted to existing washing machines, typically commercial washing machines. FIG. 4 illustrates schematically the connection to the drain outlet of a conventional washing machine. The primary washing volume has a drain outlet 42 which is connected to a drain valve 44 by a connecting pipe 46, e.g., a flexible conduit. The drain valve 44 is controlled during the washing machine cycle to cause water to either collect in the primary washing volume or drain away from the primary washing volume.

As illustrated in FIG. 5, the mixing chamber of this embodiment is adapted to be fitted between the drain outlet 42 and the drain valve 44. The supply of ozone to the mixing chamber 50 is as was described for the first embodiment. Thus, this embodiment easily allows an existing washing machine to be adapted to include an ozone dissolving system.

In the above embodiment, the ozone dissolving chamber is constructed from stainless steel. However, it will be appreciated that other materials, which are gas and water tight and have good corrosion resistance properties, could also be used for manufacture of the ozone dissolving chamber.

With reference now to FIG. 6, a detailed description concerning a still further improvement of the present invention will now be discussed in detail.

According to this embodiment, as is conventional in the art, the ozone system 60 generally comprises a washing machine 62 which, during use, is filled with a suitable volume of liquid or water 64, i.e., a washing volume, to facilitate washing of the laundry 66 contained within the washing machine 62. The water is typically supplied from a water supply source 30 to a rotatable internal drum 68, defining an internal chamber 70 within the washing machine 62, via an inlet 72. As is conventional in the art, the washing machine 62 is provide with a hinged door 74, typically located on either the top or front of the washing machine 62, which forms a water tight seal with the door opening 76 of the washing machine 62 when the door 74 is latched in a closed position in a conventional fashion (the door is shown in the front in FIG. 6). The door 74, when in its opened position, facilitates adding and removing laundry 66 from the washing machine 62. As such door and its latching mechanism is conventional and well known in the art, a further discussion concerning the same is not provided.

Prior to filling the washing machine 62, a drain valve 78 is closed to facilitate retention of the water 64 supplied to the internal chamber 70 of the washing machine 62 via the water supply source 30. In addition, the washing machine 62 is equipped with an ozone generator 80 which commences production of ozone and injects the produced ozone into the sump 82 of the washing machine 62, via a pair of spargers 34, where the ozone is discharged and permeates and bubbles through the water 64. The ozone and water are further agitated, during operation of the washing machine 62, due to the to and fro rotational motion of the internal drum 68 to intimately mix and disperse the ozone, supplied via the spargers 34, throughout the entire wash volume so that the ozone is readily available to react with the soap, dirt, soil, grime, germs, bacteria, etc., and the laundry 66 contained within the internal cavity 70 of the washing machine 62 during a wash cycle.

Preferably, a conventional air supply device/oxygen concentrator 84 compresses room air to about 5 pounds of pressure or so and supplies the pressurized room air, via a conventional duct or pipe 85, to an air flow control valve 86 which regulates the flow rate of the air being supplied to the washing machine 62. The air supply device/oxygen concentrator 84, during normal compression of the air, typically removes nitrogen for the air to increase the oxygen content of the air and thus facilitate subsequent production of ozone. The air supply device/oxygen concentrator 84 also typically removes water, moisture and other impurities from the air prior to pumping the same to the air flow control valve 86.

The air flow control valve 86 is connected, via a conventional duct or pipe 87, to supply the pressurized and regulated air to an inlet of the ozone generator 80 where a portion of such air, e.g., typically about 5% of the supplied air, is converted into ozone in a conventional fashion. As such conversion of air into ozone is conventional and well known in the art, a further detailed discussion concerning the same is not provided. An outlet of the ozone generator 80 is connected, via a conventional duct or pipe 88, to supply the generated ozone to the spargers 34 located in the sump 82 of the washing machine 62.

If desired, the air supply device/oxygen concentrator 84 may incorporate a drying unit which further assists with adequately drying the air, i.e., removes substantially all of the moisture therefrom, prior to supplying the same to the air flow control valve 86. Alternatively, a separate air drier unit 90 (see FIG. 7) may be provide somewhere along the air supply path prior to the air being supplied to the ozone generator 80 to assist with removing moisture therefrom.

The ozone, produced by the ozone generator 80, is supplied to the sparger or spargers 34 and injected into the water 64 contained within the sump 82 of the washing machine 62 via one or more injector nozzles 92 supported by the spargers 34 (see FIG. 8). Preferably, the injector nozzles 92 injects the ozone downwardly toward the drain valve 78 to facilitate further suspension, entrainment, encapsulation, dispersion and/or mixing of the ozone in the water 64 contained within the sump 82 and thereby provide a more uniform mixture and dispersion of the ozone within the water 64 contained within the sump 82.

As previously indicated, the produced ozone typically has a particle size of about 2 microns to 20 microns such that the ozone is not readily dissolved, to any substantial extent, in the water 64 contained in the sump 82 but is preferably encapsulated, suspended, dispersed and/or entrained within the water 64 and thus the ozone is readily available to react with any dirt, soil, grime, grease, germs, bacteria, etc., contained in the laundry 66 being washed by the washing machine 62. As is conventional, the ozone will only typically last for a time period of between about 2 to about 5 minutes or so before the ozone naturally converts back into oxygen.

To facilitate control of the amount of ozone generated, an ozone exhaust detector or sensor 94 is provided in or adjacent one of the conventional exhaust vents or outlets 96 of the washer machine 62, e.g., such as the soap vent, air bleed-off vent, etc. This ozone exhaust sensor 94 will monitor the air escaping or exhausting from the washer machine 62, during operation thereof, and detect the concentration of ozone contained within the escaping air. In the event that the ozone concentration level of the air exhausting from the washing machine 62 is above a safe level, e.g., above 1.0 parts per million for example, the ozone exhaust sensor 94 will then convey a signal to a relay 98 which controls the supply of electrical power to the ozone generator 80 so as to thereby "trip" or interrupt further production of ozone by the ozone generator 80 for a sufficient period of time, e.g., any where from a few seconds to about thirty minutes or so, until the ozone exhaust sensor 94 again detects a safe level of ozone, e.g., detects an ozone level in the escaping air below 1.0 parts per million, for example.

Any ozone which collects on a detection surface of the ozone exhaust sensor 94 will typically remain there until the ozone eventually "burns off" or is naturally converted back to oxygen over time by a natural conversion process. Generally, the ozone will last anywhere between about 2 to about 20 minutes or so, e.g., typically lasting between 3 and 5 minutes, before the ozone naturally converts back into oxygen. As long as the ozone exhaust sensor 94 detects an excessive amount of ozone, e.g., an amount of ozone greater than the adjusted sensitivity position of the ozone exhaust sensor 94 (e.g., the ozone exhaust sensor 94 is typically set to detect from about 0.3 to about 1.0 parts per million of ozone, for instance), the ozone exhaust sensor 94 will maintain the relay 98 in an active state or tripped state so as to prevent the supply of electrical power to the ozone generator 80 and thereby prevent the production of additional ozone. As soon as substantially all of the ozone (depending upon the sensitivity setting of the ozone exhaust sensor 94) which collected on the surface of the ozone exhaust sensor 94 has sufficiently "burned off" or dissipated, the ozone exhaust sensor 94 will then discontinue sending a signal to the relay 98, which is interrupting the supply of electrical power to the ozone generator 80. As a result the relay 98 again allows electrical power to be supplied to the ozone generator 80 and the ozone generator 80 then immediately commences further production of additional ozone for use during a subsequent stage(s) or step(s) of the wash cycle.

The system 60 is also equipped with an area ozone level detector or sensor 100 which monitors the level of the ozone contained within a room or area accommodating the washing machine 62 or a plurality of washing machines 62, e.g., at a laundry mat or a commercial washing facility such as a hospital, for example. In the event that the area ozone level sensor 100 detects an excessively high or unsafe amount of ozone located within the room or area accommodating the one or more washing machines 62, e.g., detects a room concentration level of ozone in excess of 0.1 parts per million, the area ozone level sensor 100 will then convey a signal to a relay 98 which "trips" or interrupt further production of ozone by each ozone generator 80 for a sufficient period of time, e.g., any where from a few seconds to about thirty minutes or so or possibly completely shuts down all of the washing machine (s) 62 to prevent any further production of ozone by any of the ozone generators 80, until the area ozone level sensor 100 again detects a safe level of ozone in the room or area accommodating the washing machine(s) 62, e.g., detects an ozone level within the room or area below 0.1 parts per million for example. The sensitivity setting for the area ozone level sensor 100 is also typically adjustable but typically has a sensitivity range of between about 0.03 to about 0.1 parts per million or so. Alternatively, the area ozone level sensor 100 will merely shut off or interrupt the supply of power to the air supply device/oxygen concentrator 84 which supplies the pressurized air to the ozone generator 80 and thereby interrupt further production of ozone.

This relay 98 will remain tripped or activated until the area ozone level sensor 100 again determines that an acceptable level of ozone is currently present in the room or area accommodating the washing machine(s) 62. Once this occurs, the area ozone level sensor 100 will discontinue sending a signal to the relay 98, which deactivates the relay 98 so that the relay 98 again allows power to flow to the ozone generator(s) 80 and/or the air supply device/oxygen concentrator 84 which then again allow production or manufacture of additional ozone during the remainder of the wash step or stage. The area ozone level sensor 100 prevents a hazardous condition from occurring during operation of one or more washing machines 62 due to production of excessive ozone.

Preferably, the area ozone level sensor 100 is connected to a relay 98 which controls the supply or interruption of electrical power to only the air supply device/oxygen concentrator 84 in order to control production of the ozone during operation of the washing machine 62. As a result of such electrical power interruption, the production of ozone is discontinued or interrupted since no pressurized air flows through the ozone generator 80 and thus no ozone is produced by the ozone generator 80 even though it still may be supplied with electrical power. Alternatively, the relay 98, when tripped or activated by the ozone exhaust sensor 94 and/or the area ozone level sensor 100, can also be coupled to the ozone generator 80, and/or the air supply device/oxygen concentrator 84 and/or the air flow control valve 86 so as also to control operation of all of those components and interrupt the supply of electrical power to one, two or all three of the ozone generator 80, the air supply device/oxygen concentrator 84 and/or the air flow control value 86 when an excessive amount of ozone is detected.

It is to be appreciated that there are a variety of different ways for interrupting the production of ozone by the ozone generator 80. For example, the ozone exhaust sensor 94 and/or the area ozone level sensor 100 can activate a valve (not shown), located between the air flow control valve 86 and the ozone generator 80 which diverts the supplied air directly to the spargers 34 so that the air can mix with the water 64 contained in the sump 82. The important aspect is that the system is controlled, in some manner, so as to be no longer able to produce ozone until the ozone exhaust sensor 94 and/or the area ozone level sensor 100 again detect a safe level of ozone both within the washing machine and within the room or area.

Although the above embodiments suggest that the ozone exhaust sensor 94 and the area level ozone sensor 100 each have a fixed setting, e.g., 1.0 parts per million of ozone for the ozone exhaust sensor 94 and 0.1 parts per million of ozone for the area level ozone sensor 100, it is to be appreciated that one or both of the ozone exhaust sensor 94 and/or the area level ozone sensor 100 could be a variable sensor. That is, as the ozone sensor(s) 94 or 100 detects the ozone level in the exhausting air or room approaching either 1.0 or 0.1 parts per million of ozone, depending upon the setting of the particular sensor, the ozone sensor 94, 100 will issue a variable command to the ozone generator 80 which proportionally decreases or reduces the amount of ozone being produced and thereby continuously maintain a safe level of ozone which is either being exhausted from the washing machine and/or located within the room or area accommodating the washing machine(s) 60. It is to be appreciated that if the ozone sensor (s) 94 or 100 senses that the ozone level is only gradually approaching an unsafe level of ozone, the ozone sensor(s) 94 or 100 will send a signal which gradually reduces the production of ozone by the ozone generator 80. If, however, the ozone sensor(s) 94 or 100 senses that the ozone level is rapidly approaching an unsafe level, the ozone sensor(s) 94 or 100 will issue a signal quickly reducing or possibly completely interrupting the production of ozone. Such variable control of the ozone generator 80, by the ozone exhaust sensor 94 and/or the area level ozone sensor 100, tends to minimize the duration of time, if any, that the ozone generator 80 is not actually producing any ozone during operation of the washing machine and tends to result in a more continuous supply of ozone to the washing machine to ensure that an adequate supply of ozone is always present in the washing machine during each wash cycle.

Typically during a commercial wash cycle, generally there are about eight wash steps or stages. The first stage is typically when the greatest amount or quantity of ozone is required and should be produced by the ozone generator 80. According to the present invention, preferably the ozone generator 80 is always set to its highest possible ozone production level so that the ozone generator 80 produces a maximum amount of ozone, e.g., produces between about 4 grams per hour of ozone at an ozone concentration level of about 5% ozone, and such ozone is immediately available for use during the first wash stage. This ozone "relaxes" the laundry and activates the laundry detergent or soap and assists with rapidly "burning off" any dirt, grime, grease, soil, etc., as well as killing any super bugs, germs or bacteria contained within the clothing or laundry 66 being washed.

In the event that either the ozone exhaust sensor 94 and/or the area ozone level sensor 100 determines that an excessive amount of ozone is present in either the air being exhausted or in the room or area accommodating the washing machine(s) 62, such ozone sensor 94 or 100 will send a signal to the relay 98 which trips or turns off the ozone generator 80 to prevent further production of ozone for a desired period of time, e.g., until an excessive amount of ozone is no longer detected by the ozone exhaust sensor 94 and/or the area ozone level sensor 100. As is noted above, once the level of the ozone in the exhaust gas(es) and/or the room or area sufficiently decreases to below a safe level, then the ozone generator 80 will then again be reactivated and allowed to commence further production of ozone and supply the same to the washing machine 62.

During the second and subsequent wash stages, since much of the dirt, grime, grease, soil, etc., has already been partially or completely removed from the clothing or laundry 66 and since much of the germs, bacteria, etc., have already been partially or completely killed, typically less ozone is required. The addition of extra ozone during the initial portion of the first wash stage assists with "relaxing" the clothing or laundry 66 such that the clothing or laundry 66 more readily releases its dirt, grime, grease, soil, etc. As a result of this increase in the amount of ozone supplied during the first wash stage, a sufficient ozone may still be present within the wash volume, within the wash drum 68, and/or within the clothing or laundry 66 at the end of the first wash stage so that either the ozone exhaust sensor 94 and/or the area ozone level sensor 100 detects excessive ozone being present and may possibly maintain the ozone generator 80 in an inactive state for one or more subsequent wash stages in a row or may maintain the ozone generator 80 in an inactive state for an initial portion of each subsequent wash stage of the wash cycle so that no additional ozone is produced.

Figure 9:
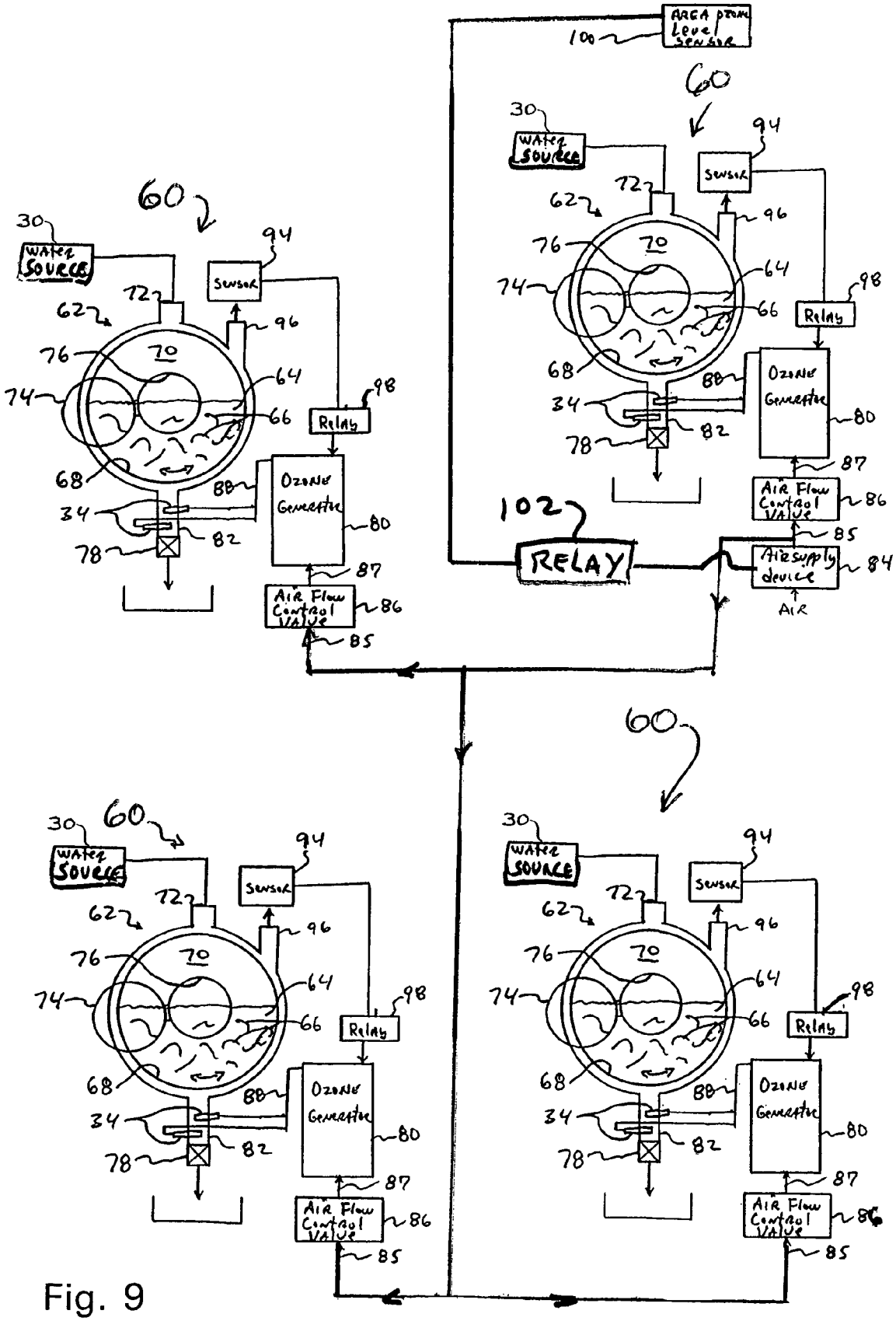
FIG. 9 shows an arrangement having a single area ozone level sensor for controlling production of ozone by a plurality of washing machines.

With reference to FIG. 9, a description concerning a plurality of washing machines will now be discussed. According to this embodiment, a single air supply device/oxygen concentrator 84 generates an adequate supply of compressed air and supplies the compressed air, via conventional ducts or pipes 85, to four individual air flow control valves 86, which each, in turn, regulate the flow rate of the air being supplied to a respective washing machine 62. Each air flow control valve 86 is connected, via a respective conventional duct or pipe 87, to supply the regulated air to an inlet of a respective ozone generator 80 where the air is converted to ozone, as discussed above, and supplied, via conventional duct or pipe 88, to the sump 82 of the respective washing machine 62. As with the previous embodiment, each one of the washing machines is equipped with an ozone exhaust sensor 94, which is provided in or adjacent a conventional exhaust vent or outlet 96 of the respective washing machine 62. In the event that the ozone exhaust sensor 94 detects an excessive amount of ozone, this sensor will control the associated ozone generator 80 to interrupt the further production of ozone until the ozone concentration level of the air exhausting from the washing machine 62 again returns back to a safe level.

According to this embodiment, however, a single area ozone level sensor 100 monitors the level of the ozone contained in the common area accommodating all four washing machines 62. In the event that the area ozone level sensor 100 detects an unsafe amount of ozone contained within the room or area accommodating the washing machine 62, the area ozone level sensor 100 will send a signal to a second relay 102 which is connected with the single air supply device/oxygen concentrator 84. The second relay 102 interrupts the flow of electrical power to the single air supply device/oxygen concentrator 84 and thus the flow of air to each one of the four ozone generators 80 so that none of the ozone generators 80 is able to manufacture any ozone. Such interruption in the production of ozone will continue until the area ozone level sensor 100 again determines that a safe level of ozone is again contained within the room. Thereafter, the flow of electrical power to the single air supply device/oxygen concentrator 84 is again established and all the ozone generators 80 are then able to manufacture ozone, provided that the ozone being exhausted from each respect washing machine is still below a safe level.

The utilization of ozone facilitates the use of relatively cold water, e.g., water at a temperature in the range of from between 35 to 55° F. or so, since the ozone activates the laundry detergent or soap, even at lower water temperatures, and thereby achieves sufficient cleaning and sanitizing of the items being laundered.

The inventors have found that by generating a sufficient amount of ozone and making this ozone initially available for use during the first wash stage, and then reducing the amount of ozone generated during the second and subsequent wash stages, this results in efficient use of the laundry soap or detergent and the water 64 while still achieving consistently cleaned and sanitized laundry 66 during each complete wash cycle of the washing machine 62.

The ozone system 60 may be equipped with an indicator which provides a visual indication that substantially all of the super bugs, germs and/or bacteria contained within the clothing or laundry 66 being washed has been killed. For example, the ozone system 60 may be equipped with separate "red" and "green" lights (labeled "R" and "G", respectively) 106 and 104, as can be seen in FIG. 6. Upon activation of the ozone system 60, the one of the relays 98 supplies electrical power to the "red" light 106 to visually indicate to the operator that the clothing or laundry 66 being washed still may have live super bugs, germs and/or bacteria. The "red" light 106 will remain illuminated until the ozone exhaust sensor 94 senses that the air exhausting from the washing machine 62 has an ozone concentration level in excess of 1.0 parts per million. Once the ozone exhaust sensor 94 determines that the ozone exhausting from the washing machine continues to have an ozone concentration level in excess of 1.0 parts per million for a desired duration of time, e.g., 30 second or more, than the system 60 will interrupt the supply of electrical power to the "red" light 106 and thereafter another relay will be activated for only supplying electrical power to and illuminating the "green" light 104 to provide a visual indication to the operator that substantially all of the super bugs, germs and/or bacteria contained within the clothing or laundry 66 being washed has been killed. It is to be appreciated that the "red" light 106 will remain illuminated until the ozone exhaust sensor 94 determines that the air exhausting from the washing machine continues to have an ozone concentration level at or above 1.0 parts per million for a desired duration of time, e.g., 30 second or more. Each time the door 74 is opened and/or closed, the ozone system 60 is reset, e.g., the system returns back to only illuminating the "red" light 106.

Since certain changes may be made in the above described improved ozone generating and monitoring system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A system for controlling a supply of ozone supplied for laundering clothing, the system comprising at least one washing machine with an air supply device for supplying air to each washing machine; and each washing machine comprising:

an internal drum for containing laundry and a quantity of a water;

a sump located vertically below the washing machine, and the sump having a drain valve facilitating retention of the water supplied to the washing machine;

at least one exhaust outlet being provided in the washing machine for exhausting gas from the washing machine; and an air flow control valve for regulating a flow rate of the air being supplied to the washing machine, and the air flow control valve being connected to an ozone generator for producing ozone from the air, and the ozone generator being connected with the sump to supply the produced ozone to the washing machine;

an ozone exhaust sensor continuously sensing a level of ozone exhausting from the washing machine in the exhaust gas during operation thereof, the at least one sensor being located in the at least one exhaust outlet for detecting a concentration of ozone contained within the exhaust gas as the exhaust gas exits the at least one exhaust outlet, and a relay coupling the at least one sensor to the ozone generator for temporarily interrupting production of ozone by the ozone generator when the level of ozone exhausting from the washing machine in the exhaust gas exceeds about 0.1 parts per million until the ozone exhaust sensor again detects a level of ozone in the exhaust gas below about 0.1 parts per million of ozone, so that the ozone generator can again commence further production of ozone;

an area ozone level sensor for detecting a level of the ozone contained within an area accommodating the at least one washing machine, and in an event that the area ozone level sensor detects the ozone level for the area to be above about 0.1 parts per million, the area ozone level sensor interrupts further production of ozone by each generator until the area ozone level sensor again detects a level of ozone below about 0.1 parts per million.

2. The system for controlling the supply of ozone to the washing machine according to claim 1, wherein the air supply device includes a drying unit which removes moisture from the air, prior to supplying the air to the air flow control valve.

3. The system for controlling the supply of ozone to the washing machine according to claim 1, wherein a plurality of spargers are located within the sump, and the plurality of spargers each contain at least one injection nozzle for injecting the produced ozone into the water located within the sump.

4. The system for controlling the supply of ozone to the washing machine according to claim 3, wherein the plurality of injector nozzles injected the ozone, having a particle size of from about 2 microns to about 20 microns, so as to facilitate mixing of the ozone with the water contained within the sump and thereby provide uniform mixture thereof.

5. The system for controlling the supply of ozone to the washing machine according to claim 1, wherein the ozone supplied to the washing machine has a particle size of from about 2 microns to about 20 microns.

6. A system for controlling a supply of ozone to a washing machine during operation thereof, the system comprising:

a washing machine having an internal drum for containing laundry and a quantity of a water;

an ozone generator, connected to the washing machine, for producing ozone and supplying the produced ozone directly to a sump of the washing machine and ozonating the water in the sump, and at least one exhaust outlet being provided in the washing machine for exhausting gas from the washing machine; and at least ozone exhaust sensor for sensing a level of ozone being exhausted from the washing machine in the exhaust gas during operation thereof, the ozone exhaust sensor being located in the at least one exhaust outlet for detecting a concentration of ozone contained within the exhaust gas exiting the at least one exhaust outlet, and a relay coupling the ozone exhaust sensor to the ozone generator for temporarily interrupting production of ozone, produced by the ozone generator, when the level of ozone in the exhaust gas being exhausted from the washing machine exceeds about 0.1 parts per million until the ozone exhaust sensor again detects a level of ozone in the exhaust gas below about 0.1 parts per million of ozone, so that the ozone generator can again commence further production of ozone;

an area ozone level sensor for sensing a level of ozone within a room accommodating the washing machine, the area ozone level sensor being located within the room for monitoring an ozone level of the room, and a relay coupling the area ozone level sensor to the ozone generator for interrupting production of ozone, produced by the ozone generator, when the level of ozone in the room exceeds about 0.1 parts per million;

an air supply device supplies air to an air flow control valve which regulates a flow rate of the air being supplied, and the air flow control valve is connected to supply the air to the ozone generator for conversion of the air into ozone, and the ozone generator is connected to supply the ozone to the sump of the washing machine and the air supply device incorporates a drying unit which removes moisture from the air, prior to supplying the air to the air flow control valve;

the sump is located vertically below the washing machine and a drain valve, when in a closed position, facilitates retention of the water supplied to the washing machine, and the drain valve, when in an opened position, facilitates drainage of the water from the washing machine and an outlet of the ozone generator is connected to the sump of the washing machine, and the produced ozone is discharged into the sump so as to permeates and bubbles through the water within the sump to at least partially encapsulate the ozone in the water.

7. The system for controlling the supply of ozone to the washing machine according to claim 6, wherein at least one of the ozone exhaust sensor and the area level ozone sensor is a variable sensor issues a variable command to the ozone generator for proportionally decreases or reduces the amount of ozone being produced and thereby continuously maintain the ozone being exhausted from the washing machine, below about 0.1 parts per million, and contained within the room.

8. The system for controlling the supply of ozone to the washing machine according to claim 7, wherein the ozone generator produces about 4 grams per hour of ozone at an ozone concentration level of about 5% ozone and so that ozone is immediately available for use during the first wash stage.

9. The system according to claim 1, wherein the system is equipped with an indicator which is only activated once substantially all of the superbugs, germs and bacteria, contained within laundry, have been killed.

10. The system according to claim 1, wherein the system is equipped with at least one light which only becomes illuminated once an ozone exhaust sensor senses that the exhaust gas, from the washing machine, has an ozone concentration level in excess of 1.0 parts per million to provide a visual indication that substantially all of the super bugs, germs and bacteria, contained within the laundry being washed, have been killed.

11. The system according to claim 1, wherein the system is equipped with an indicator which indicates the presence of ozone in the internal drum during operation of the washing machine.

12. The system according to claim 1, wherein the system is equipped with separate first and second lights and, during operation of the system, the first light remains illuminated until the ozone exhaust sensor senses that the exhaust gas from the washing machine has an ozone concentration level in excess of 1.0 parts per million and, upon the ozone exhaust sensor sensing that the ozone exhausting from the washing machine has an ozone concentration level in excess of 1.0 parts per million for a desired duration of time, than the system interrupts the supply of electrical power to the first light and thereafter supplies power to illuminate the second light and provide a visual indication that substantially all of the super bugs, germs and bacteria, contained within the laundry being washed in the washing machine, have been killed, and the system resets and returns back to only illuminating the first light any time a door of the washing machine is opened.

* * * * *